US006655791B1

(12) United States Patent
Crockett et al.

(10) Patent No.: US 6,655,791 B1
(45) Date of Patent: Dec. 2, 2003

(54) CONTINUOUS INKJET PRINTER ARRANGEMENT

(75) Inventors: Dennis Crockett, Eye (GB); Alan L. Hudd, Nuthampstead (GB); Christopher M. Evans, Great Chesterford (GB)

(73) Assignee: KBA-Giori S.A., Lausanne (CH)

( * ) Notice: Subject to any disclaimer, the term of this patent is extended or adjusted under 35 U.S.C. 154(b) by 0 days.

(21) Appl. No.: 10/070,591

(22) PCT Filed: Sep. 8, 2000

(86) PCT No.: PCT/CH00/00484

§ 371 (c)(1),
(2), (4) Date: Mar. 8, 2002

(87) PCT Pub. No.: WO01/17786

PCT Pub. Date: Mar. 15, 2001

(30) Foreign Application Priority Data

Sep. 9, 1999 (EP) ..... 99810810

(51) Int. Cl.[7] ..... B41J 2/175
(52) U.S. Cl. ..... 347/85; 347/88; 347/89
(58) Field of Search ..... 347/73, 85, 87, 347/89, 88, 90, 93

(56) References Cited

U.S. PATENT DOCUMENTS

| | | | | |
|---|---|---|---|---|
| 4,106,030 A | | 8/1978 | Hampton | |
| 4,459,469 A | | 7/1984 | Ishima | |
| 4,700,202 A | * | 10/1987 | Kuranishi et al. | 347/86 |
| 4,746,928 A | * | 5/1988 | Yamada et al. | 347/75 |
| 5,771,052 A | * | 6/1998 | Hine et al. | 347/42 |

FOREIGN PATENT DOCUMENTS

| | | |
|---|---|---|
| EP | 0642924 A | 3/1995 |
| JP | 56086762 A | 7/1981 |
| JP | 57083485 A | 5/1982 |
| JP | 61188160 A | 8/1986 |
| JP | 03295661 A | 12/1991 |
| JP | 10000790 A | 1/1998 |

* cited by examiner

*Primary Examiner*—Anh T. N. Vo
(74) *Attorney, Agent, or Firm*—Clifford W. Browning; Woodard, Emhardt, Moriarty, McNett & Henry LLP

(57) ABSTRACT

A continuous inkjet printer is described, which includes a combination of dispersion agitation means, heated ink supply and printhead and tailored, heated, filtration regime. The use of this combination allows the printing of inks containing a non-magnetic pigment that exhibits "soft settling" upon standing.

10 Claims, 3 Drawing Sheets

CONTINUOUS INKJET PRINTER ARRANGEMENT

The subject matter of the present invention is a continuous inkjet printing arrangement comprising a single nozzle continuous inkjet printhead provided with heating means, an ink supply line connecting an ink source to the printhead and returning gutter ink from the printhead to the ink source, a filter in said supply line and ink supply management means for controlling the supply of ink to the said printhead.

BACKGROUND OF THE INVENTION

It is known (U.S. Pat. No. 3,999,190) that the viscosity of the ink just prior to dispersement from the printing head must be accurately controlled in order to maintain proper droplet formation, and that heating the printhead to a preselected temperature permits to accurately control the viscosity. It is also known (U.S. Pat. No. 4,106,030) that a continuous inkjet printhead must be supplied with filtered ink.

However the viscosity of inks intended to be applied to continuous inkjet printing arrangements still remains an important problem in the inkjet printing technology, particularly in view of the fact that there is an increasing interest in printing inks containing a high loading of pigment, for example inks containing chemically or thermodynamically stabilised pigments, high abrasive and high-density inorganic pigments, or inks that contain security features such as fluorescent pigments.

SUMMARY OF THE INVENTION

The aim of the present invention is to propose a continuous inkjet printer arrangement able to be used advantageously for printing inks of the above mentioned type.

To this end the present invention relates to a continuous inkjet printer arrangement comprising a single nozzle continuous inkjet printhead provided with heating means, an ink supply line connecting an ink source to the printhead and returning gutter ink from the printhead to the ink source, a filter in said supply line and ink supply management means for controlling the supply of ink to the said printhead, wherein the filter is provided with heating means and the ink supply management means are arranged for continuously maintaining in said filter a temperature higher than elsewhere in the ink supply and for maintaining said printhead at a constant temperature higher than the ambient temperature.

The filter may be located in a metal housing containing an electrical heating element. In particular, the filter may be located between two metal plates one of which is provided with a heating means.

At least five static mixers may be incorporated at strategic points within the system, where two static mixers may be incorporated in said ink supply line, one of which is located immediately upstream of said filter, the other being located immediately downstream of said filter.

According to an embodiment, the filter may be mounted immediately adjacent to the printhead.

According to another embodiment, the ink supply line may be connected to at least one element of the ink supply management system between the downstream end of the static mixer following the filter and the inlet of the printhead.

The static mixers in the ink supply line may be heated.

BRIEF DESCRIPTION OF THE DRAWINGS

A preferred embodiment and an alternative of the arrangement according to the invention will now be described in reference to the drawing wherein.

DETAILED DESCRIPTION OF THE PREFERRED EMBODIMENT

Figure 1:
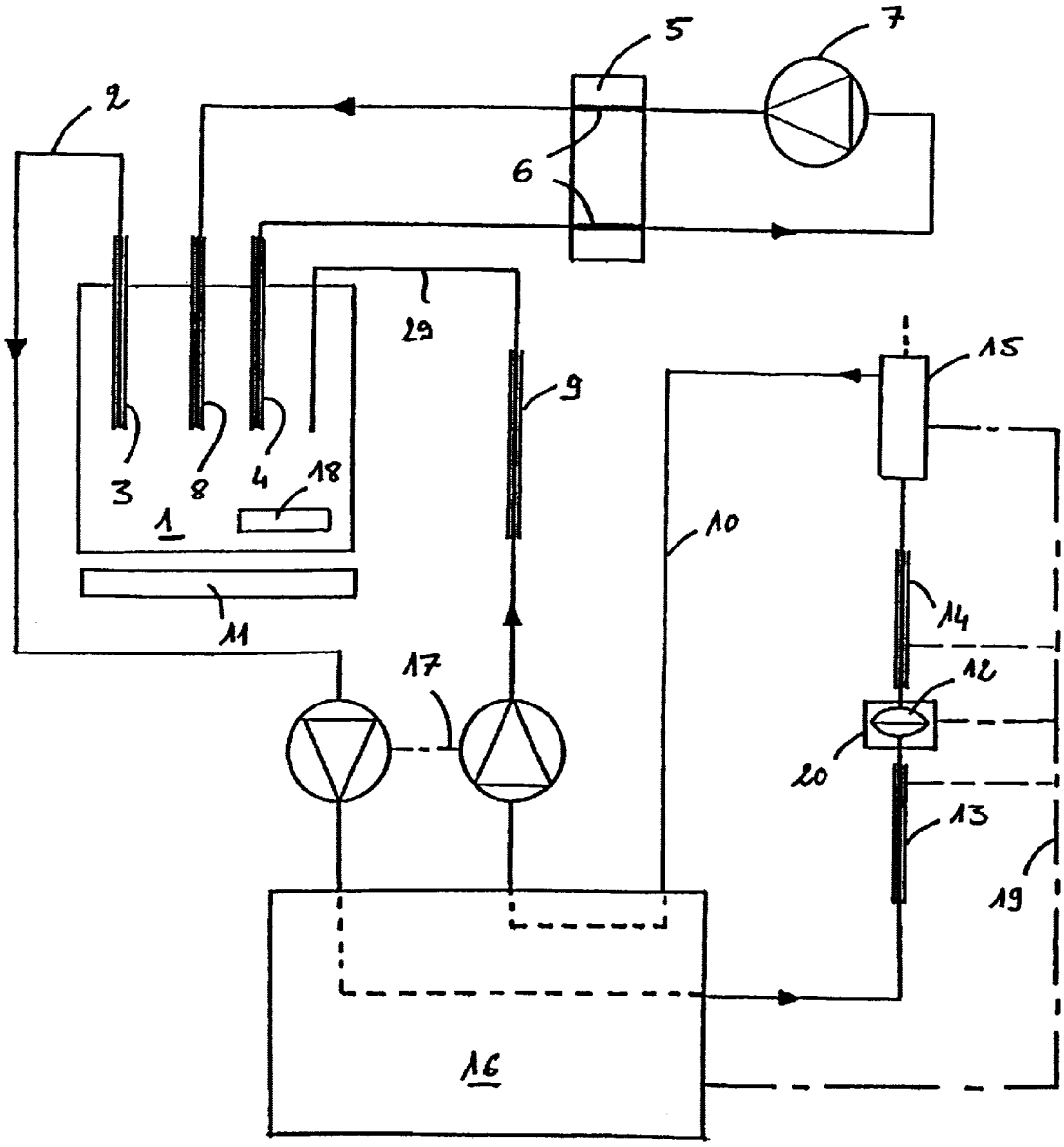
FIG. 1 is a schematic diagram of the arrangement according to the preferred embodiment.

Referring to the drawing, reference 1 designates an ink reservoir. The shape of this reservoir should preferably be such that efficient stirring of the ink is facilitated. It should not contain any "dead" volume. A cylindrical shape with a rounded bottom edge has been shown to be satisfactory. Also a hemispherical shape of the reservoir would be satisfactory. One experimental implementation of this concept has utilised a 500 ml circular jar with a screw-on lid as a reservoir.

Ink is picked up in the reservoir through a feed line 2 and passes through a first static mixer 3. A static mixer is a well known apparatus which consists of a series of left and right hand helical elements located within a straight tube part. Several companies manufacture mixers of this type. Those manufactured by TAH Industries Inc., of New Jersey USA as well as those manufactured by Statiflo International Ltd., of Cheshire UK have been found to be useful.

Ink pick up line 2 feeds a pump assembly 17 and an ink supply and management system 16.

References 4 to 8 designate an ink recirculation loop which constitutes an important part of the schema. Ink is taken out of the tank 1 through a second static mixer 4, is passed through a stainless steel tube 6, then through a recirculation pump 7 which is preferably a peristaltic pump, then through a further stainless steel tube 6 and returned to the reservoir 1 through a third static mixer 8. Both stainless steel tubes 6 are parallely sunk within the same aluminium block 5 provided with heating means, allowing the stainless steel tubes 6 to be maintained at a constant temperature. The flow rate through the recirculation loop is maintained at a rate several times faster than the flow of ink through the printing side of the system.

Tank 1 finally comprises the return line 29 coming out of the ink management system 16 and going through a fourth static mixer 9. Said fourth mixer 9 is however optional. Acceptable results have been obtained without the same.

Tank 1 is positioned on top of a magnetic stirrer 11 and contains a magnetic stirrer bead 18. Thus two independent agitation means are provided: the recirculation loop 4–8 and the additional stirrer 11 and 18. The latter could also be a rotating mechanic stirrer.

The ink management block 16 includes the pump assembly 17, here symbolised through a pair of separate suction and driving pumps. However this representation is provided as an example only. The ink management block further includes a number of connection and valve and control means which are not represented in detail and which ensure control of the pressure and the composition of the ink: ink supply, solvent supply, measurement of viscosity, flow rate control, etc., as well as feeding of wash liquid. This system may include ink make up reservoir, solvent reservoir, etc.

A further line feeds ink from the management block 16 to the printhead 15. It comprises fifth and sixth static mixers 13 and 14 respectively and a filter 12 provided between the static mixers 13 and 14. Filter 12 is provided with heating means. At the outlet of mixer 14 the ink enters printhead 15 which is a single nozzle heated printhead. The gutter of printhead 15 is returned to ink management block 16 through line 10 and from there to the ink reservoir 1 through static mixer 9.

Figure 2:
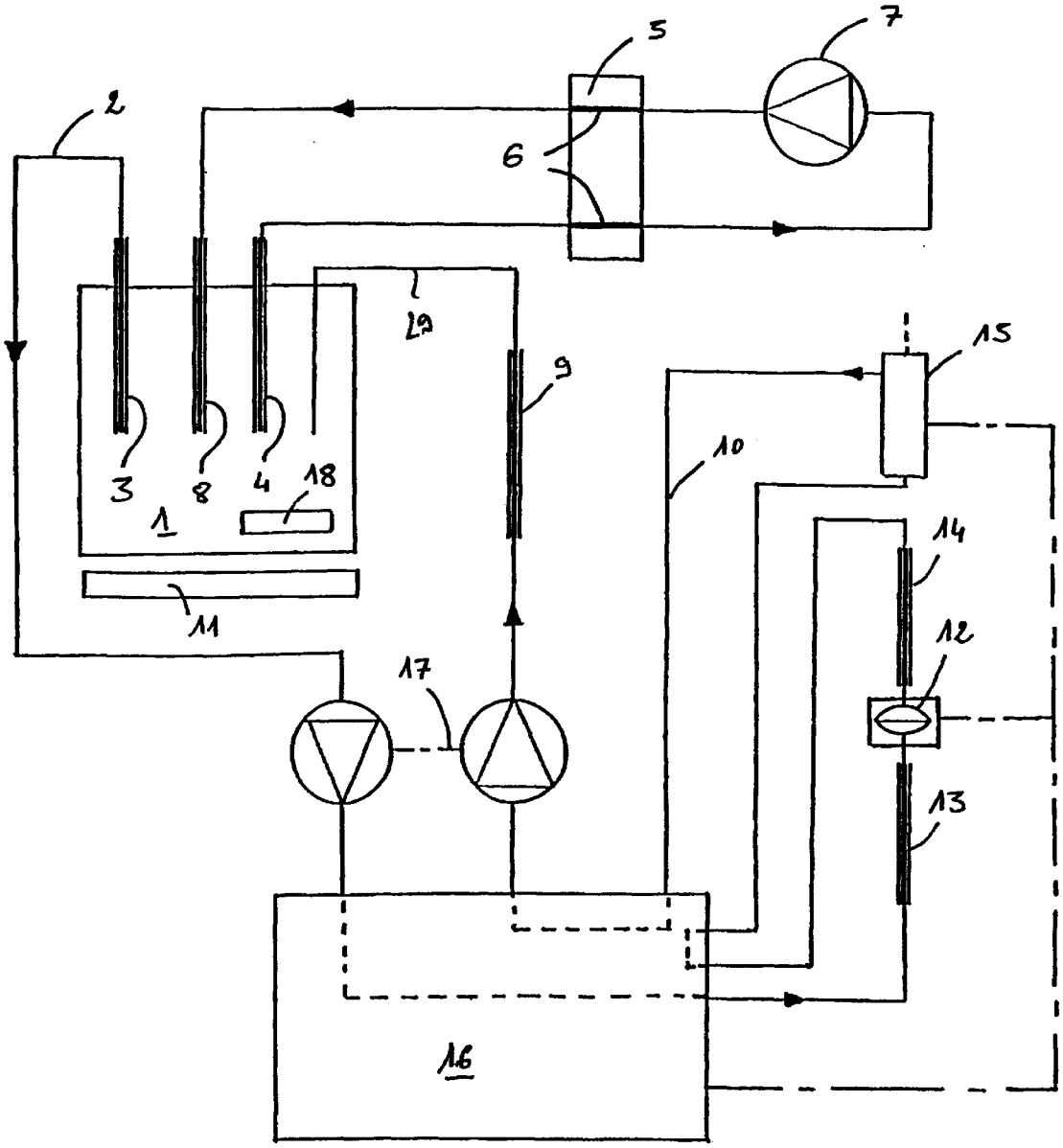
FIG. 2 is a diagram corresponding to FIG. 1 showing the alternative embodiment and FIG. 3 is a schematic view of a heated filter means.

As can be seen in FIGS. 1 and 2, a connection 19 is provided between ink management bloc 16 and heated filter 12 on the one hand and heated printhead 15 on the other hand. Connection 19 is an electrical circuit used to heat the printhead 15 and filter 12 and for controlling the temperature of the same.

Heated printheads are known per se. For heating the filter 12, many ways can be chosen for achieving it. An example will be given with reference to FIG. 3. On FIGS. 1 and 2 the filter 12 is enclosed in a housing 20.

Passage of heated ink successively through a static mixing element 13, a heated depth filter (12, 20), and a second static mixing element 14 prior to passage to the printhead, and possibility of maintaining the printhead at a constant elevated temperature during the printing process are two main features of the present invention. It has been shown that these features are decisive for printing inks containing high loading of pigment, more particularly security features such as fluorescent pigments.

It has been found that by using a continuous inkjet printhead of known type in the described arrangement and by setting the head temperature at 50 degrees C. and by raising the ink supply to 45–50 degrees C. printing of inks with room temperature viscosities in excess of 12 cPs was possible. The need to incorporate both a heated printhead and a heated ink delivery system is demonstrated.

The use of a heated filter is a key component of the present invention. Excellent flow characteristics have been achieved through the use of a heated filtration regime and through incorporation of static mixers on the inlets to the filters. The purity of flow through the filter is improved and less pressure is required to achieve an acceptable flow rate. Using high pressure with high viscosity inks can cause the filtration media to compress, changing the shape and dimensions of the interstices within the media and thereby reducing the purity of flow and altering the filtration characteristics of the filter. By heating the ink, the viscosity is reduced and so the filtration properties of the ink can be improved. However reducing the viscosity increases the rate of pigment settlement. Therefore it is desirable to heat the ink to a higher temperature in the region of the filter, than elsewhere in the ink supply line. This improves the filtration properties whilst minimising the settling rate elsewhere in the printer.

The addition of a static mixer to the inlet of the filter means that the ink entering the filter is homogeneous and prevents filter blockage or loading caused by heterogeneous flow of pigment rich ink. A static mixer on the exit or outlet of the filter ensures that the ink leaving the filter is homogeneous. This is especially important just prior to the nozzle as ink homogeneity is a key requirement for reliable drop formation and jetting.

In positioning the heated filter relative to the printhead, it is important to ensure that as little temperature loss as possible occurs. According to FIG. 1 the filter 12 is mounted with its outlet mixer 14 immediately adjacent the printhead 15. As shown by FIG. 2 it may be necessary to connect an ink management manifold belonging to system 16 within the supply line between mixer 14 and head 15, but the requirement of minimizing the temperature loss between filter and printhead must be preserved.

Figure 3:
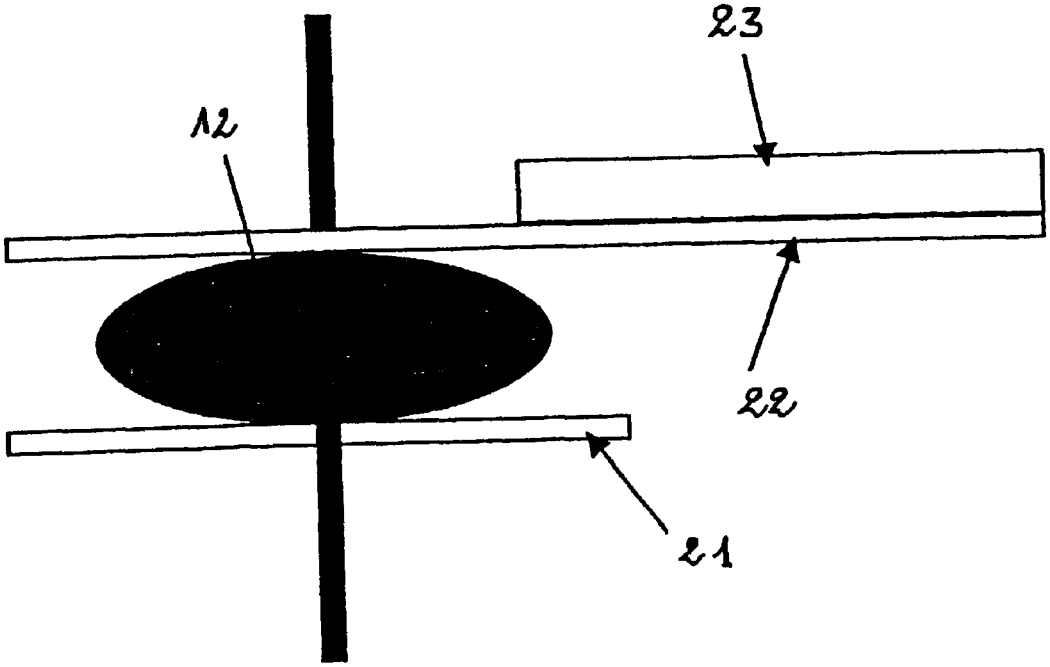

FIG. 3 schematically shows the constructive arrangement of filter 12. Filter 12 is a 20-micron filter. It is located between two metal plates 21 and 22, plate 22 having a heater element 23 attached to the reverse side. The filter could also be wrapped in a heat tape or contained in a heated housing.

As hereabove described, the use of the correct temperature profile in the ink supply to the printhead is a key part of the invention. Thus, the optimum temperature profile to be used with a given ink must be determined specifically for that ink such that:

The temperature of the printhead is controlled such that the ink has the ideal viscosity for use with that specific printhead configuration.

The filter is held at a temperature at which efficient filtration can be achieved at the pressure existing within the ink supply.

The temperature of the printhead is higher than ambient temperature.

The temperature of the filter is higher than that within the rest of the ink supply other than the printhead.

The temperature of the ink supply may be higher than ambient.

What is claimed is:

1. A continuous inkjet printer arrangement comprising a single nozzle continuous inkjet printhead provided with first heating means, an ink supply line connecting an ink source to the printhead and returning gutter ink from the printhead to the ink source, a filter in said supply line and ink supply management means for controlling the supply of ink to the said printhead, wherein the filter is provided with second heating means and the ink supply management means are arranged for continuously maintaining in said filter a temperature higher than elsewhere in the ink supply and for maintaining said printhead at a constant temperature higher than the ambient temperature.

2. The arrangement according to claim 1, wherein the filter is located in a metal housing containing an electrical heating element.

3. The arrangement according to claim 1, wherein the filter is located between two metal plates one of which is provided with a heating means.

4. A continuous inkjet printer arrangement comprising a single nozzle continuous inkjet printhead provided with first heating means, an ink supply line connecting an ink source to the printhead and returning gutter ink from the printhead to the ink source, a filter in said supply line and ink supply management means for controlling the supply of ink to the said printhead, wherein the filter is provided with second heating means and the ink supply management means are arranged for continuously maintaining in said filter a temperature higher than elsewhere in the ink supply and for maintaining said printhead at a constant temperature higher than the ambient temperature, and wherein at least five static mixers are incorporated at strategic points within the system.

5. The arrangement according to claim 4, wherein two static mixers are incorporated in said ink supply line, one of which is located immediately upstream of said filter, the other being located immediately downstream of said filter.

6. The arrangement according to claim 5, wherein the static mixers in the ink supply line are heated.

7. The arrangement according to claim 5, wherein the filter is mounted immediately adjacent to the printhead.

8. The arrangement according to claim 7, wherein the static mixers in the ink supply line are heated.

9. The arrangement according to claim 5, wherein the ink supply line is connected to at least one element of the ink supply management system between the downstream end of the static mixer following the filter and the inlet of the printhead.

10. The arrangement according to claim 9, wherein the static mixers in the ink supply line are heated.

* * * * *